US005190282A

United States Patent [19]

Rabindran et al.

[11] Patent Number: 5,190,282

[45] Date of Patent: Mar. 2, 1993

[54] MULTI-PASS SORTING MACHINE

[75] Inventors: K. George Rabindran, Morton Grove; Thomas Faber, Skokie; David Filicicchia, Schaumburg; Kenneth L. Guenther, Park Ridge; Joseph Kalika, Niles; Melvin T. Kerstein, Lincolnwood; Girish B. Shah, Schaumburg; David Wiley, Palatine, all of Ill.

[73] Assignee: Bell & Howell Company, Skokie, Ill.

[21] Appl. No.: 731,513

[22] Filed: Jul. 17, 1991

Related U.S. Application Data

[62] Division of Ser. No. 500,408, Mar. 27, 1990, Pat. No. 5,143,225.

[51] Int. Cl.[5] ..... B65H 5/02

[52] U.S. Cl. ..... 271/272; 271/34; 271/121; 271/275

[58] Field of Search ..... 271/34, 121, 125, 272, 271/273, 274, 202, 270, 275

[56] References Cited

U.S. PATENT DOCUMENTS

| | | | |
|---|---|---|---|
| 3,007,572 | 11/1961 | Renshaw | 209/110 |
| 3,024,904 | 3/1962 | Gray et al. | 209/74 |
| 3,051,333 | 8/1962 | Richert et al. | 214/7 |
| 3,261,464 | 7/1966 | Levy | 209/72 |
| 3,363,782 | 1/1968 | Burkhardt et al. | 214/7 |
| 3,378,251 | 4/1968 | Donabin | 271/3 |
| 3,602,369 | 8/1971 | Bernardis | 209/73 |
| 3,771,783 | 11/1973 | McInerny | 271/175 |
| 3,918,704 | 11/1975 | Sugiyama et al. | 271/201 |
| 4,388,994 | 6/1983 | Suda et al. | 209/564 |
| 4,534,550 | 8/1985 | Reist | 271/270 X |

FOREIGN PATENT DOCUMENTS

| | | | |
|---|---|---|---|
| 0152736 | 9/1983 | Japan | 271/121 |

*Primary Examiner*—H. Grant Skaggs
*Assistant Examiner*—Carol Lynn Druzbick
*Attorney, Agent, or Firm*—Welsh & Katz, Ltd.

[57] ABSTRACT

The multi-pass sorting machine of this disclosure includes a supporting structure which has the configuration of an A-Frame. The A-Frame structure has a slanting front side supporting several individually functional devices and a slanting back side supporting other individually functional devices. The devices of the front side include an input feeding means, a first transporting means, a singulating means, an accelerating means, a second transporting means, a bar code reader and associated electronic and computer means, a plurality of first sorting means in the form of diverting vanes, an equal number of first pass stacker buffer means, and a reversing member for transporting letters from the front side to the back side while at the same time retaining the same orientation of the letters to the planar surface as the letters go around the corner. The slanting back side supports a plurality of second sorting means in the form of diverting vanes, an equal number of second pass stacker buffer means, and an automatic mail tray loader means. The singulation means includes a powered belt means, and a singulation roller overlying and adapted to contact the belt means, with the roller being mounted on one end of a pivotable arm. The arm pivots about an axis spaced from the roller axis, and powered drive means is mounted on the pivot axis for engaging the roller for power transmission without interfering with interaction of the roller with the belt.

16 Claims, 11 Drawing Sheets

MULTI-PASS SORTING MACHINE

This is a division of application Ser. No. 500,408, filed Mar. 27, 1990, now U.S. Pat. No. 5,143,225.

FIELD OF THE INVENTION

This invention relates to a sorting machine for use in the sequential sorting of mail identified for delivery by an individual carrier. In an urban area there are approximately 3,000 pieces of mail and up to 1,000 delivery points per each individual carrier delivery. The time for sequencing of mail in pouch for an individual carrier will be reduced by approximately three (3) hours per day when the sorting machine contemplated by the present invention is utilized.

BACKGROUND OF THE INVENTION

Attempts have been made to provide sorters for use by individual carriers, such sorters having the envelopes or documents handled thereby stacked in a direction perpendicular to the face of the envelopes.

Because of this type of perpendicular stacking, stacked groups of sorted envelopes or documents assume the shape of an irregular bundle, and each of the several bins or stackers employed contains one of these bundles of envelopes or documents (hereinafter called "letters"). Because the letters depend on one another for support, handling and manipulating the bundles must be done very carefully. The bundle configuration is aggravated by the inherent random mix of letter sizes. If a bundle is to be transferred from one location to another, (for reprocessinq the letters for the second pass, for example, or for transferring them into mail trays), each bundle must be supported so that letters don't "squeeze" out of the center of the bundle, which would cause the bundle to collapse with loss of sequence and facing. Another problem with handling discrete bundles of letters is the re-assembly of the individual bundles into one continuous bundle or stack for re-processing on the second pass.

Additionally, present sorters stack letters with one edge of each letter moved against a reference edge. When letters are to be processed for the second pass sortation, they must be resingulated. Even though each letter was singulated on the previous pass, when it proceeded before the bar code or character reader, none of that singulation is retained because of the edge registration.

Further, because of the difficulty in manipulating bundles of letters, sequenced letters cannot be automatically placed into mail trays without employing complicated and expensive robotic techniques. Such robotic techniques generally require a high level of skill for maintenance and, hence, have a continuing high cost of operation factor. Because of the aforementioned problems, present sorting machines depend on manual removal of sequenced letters from the bins or sorters at the conclusion of sorting. This manual removal of mail from stackers, bins or sorters is commonly referred to as "sweeping".

GENERAL DESCRIPTION AND ADVANTAGES OF PRESENT INVENTION

The present invention relates to a "Carrier Sequenced Bar Code Sorter" (hereinafter referred to as a "CSBCS") in the form of a multi-pass sorting machine in which pre-faced letters, or other mail pieces are manually placed on an input feed tray, and letters are separated into a stream of single pieces which are passed by an optical scanner, enabling bar code or optical character reading to take place. The letters are then passed along the path of a string of diverters which are actuated in response to data from the optical scanner and associated electronic and computer means. Each diverted letter enters the input end of a stacking buffer associated with the particular diverter chosen by the optical scanner and associated electronics from the indicia on the face of the letter. Each letter entering a stacking buffer is advanced a small amount and as successive letters enter that stacking buffer they overlap the previous letter by a predetermined amount and a shingled stream of letters is formed. After all letters in a batch have been passed by the optical scanner, and the letters have been appropriately diverted into the correct stacking buffer, depending on the indicia on its face, the system is ready for the second pass sortation.

The shingled letters from the first stacking buffer are then transferred into a pair of opposed running belts which convey the shingled stream to a singulator. As the singulator takes each piece from the shingled stream of letters, the letters are passed by the optical scanner a second time. As the last of the shingled letters from the first stacking buffer leaves the stacking buffer, letters from the next stacking buffer are merged into the stream until all letters have been passed through the singulator and past the optical scanner a second time.

After the second optical scan, letters are transported past all of the diverters associated with the first pass stacking buffers, and they are moved into the path of and past a second set of diverters and stacking buffers. As with the first pass, letters are diverted in the appropriate stacking buffer by actuation of the correct diverter in response to data read on the face of the letters from the second pass past the optical scanner and introduction of that data into associated computer electronics.

At the conclusion of the second pass and separation, the letters are sequenced in the correct order, shingled and stacked in the second series of stacking buffers. The sequenced letters are then down-loaded to a pair of opposed running belts, similar to the belts engaged after the first pass. These last mentioned belts, however, transfer the shinqled stream of sequenced letters to an output trayinq device where the letters are delivered into a sequential series of mail trays.

A positive advantage of the present invention is the fact that the only manual operation is the loading of the input feed tray. The machine controls and moves the letters substantially at all times between two facing conductive elastic belts, and stacks the letters between two elastic belts with each letter overlapping the next to form a shingled stream of letters, in much the same manner as a deck of playinq cards can be spread out across a table top. The stacking of letters is done in a direction along the length of the letters, then, rather than perpendicular to the face of the letters. Because of this lengthwise overlapped shingled stacking, the stacked letters form a natural stream in which the entire stream is supported between two belts. Transferring the stack from one place to another requires only that the supporting belts be moved, and the stack flows with them with the letters supported at all points at all times.

A further benefit of this system is that the stream of letters from one stack can be easily merged with the stream of mail from the previous stack.

Still another unique and powerful feature is that the letters enter at the upper end of the generally vertically disposed stacking buffer, and they exit from the opposite lower end. The system is, then, a natural first-in/first-out system. Because letters flow into one end and out of the other, the system is also a naturally recirculating system. This results in a natural configuration for a multi-pass sorter where recirculation of the letters is required or desired.

Several side benefits are attainable as a result of this recirculating system. First, if one of the stacking buffers becomes filled up on the first pass, any overflow letters for those particular filled stacking buffers can be easily reprocessed and automatically sequenced without need for manually reintroducing these letters. The system works as follows: assume, for example, that letters overflow from stacking buffers nos. 2,3, and 4. At the conclusion of the pass 1 sortation, letters from stacking buffers 1 and 2 would be sequentially introduced into the second pass mailstream and the first two stackinq buffers 1 and 2 would become empty and available for use. After downloading letters of the pass sortation from buffers 1 and 2, letters from the overflow stacking buffer would then be downloaded. Overflow letters belonging to the letters from stacking buffer 2 would pass by all of the first pass sortation diverters and would be sequenced with the other letters from group 2 into the second pass stacking buffers, while overflow letters from stacking buffers 3 and 4 would be sorted by the first pass sortation one diverters into the now available stacking buffers 1 and 2. Then letters would be downloaded from stacking buffer 3, along with the overflow letters sorted into stacking buffer 1, and would pass by all of the first pass sortation diverters to be sequenced as all group 3 letters into the proper second pass stacking buffer, as set forth hereinafter. Then letters from stacking buffer 4 would be processed along with overflow letters sorted into stacking buffer 2 and would pass by all of the first pass sortation diverters to be sequenced as all group 4 letters into the proper second pass stacking buffer, as set forth hereinafter. Reject and purged mail can also be recycled a second time for the first pass sortation, if desired. The importance of flow-through stackers with the natural recirculation enables both of these unique capabilities.

Still another advantage, as letters are down-loaded from the first pass sortation stacking buffers, they flow into the second pass through the singulator in a shingled stream. The singulation done on the first pass is not completely lost since the lead edges of the letters overlap one another in a shingled manner. The second singulation, therefore, becomes faster and more reliable.

A still further advantage is the possibilities for flexible orientation of the first pass and second pass structures. Construction of this new machine can be done in a variety of ways. In one configuration the stacking buffers for pass one and pass two sortation can be assembled in-line. This however, requires an elongated floor plan. The preferred configuration, which minimizes the floor space required, finds a single structure with the second pass sortation stacking buffers on the back side of the first pass sortation stacking buffers. The preferred configuration results in an improved ergonomic system where mail input into the first pass is substantially at the end of one side of the machine, and the output of the second pass sortation is into mail trays at the same end of the machine, but on the opposite side. A third configuration would be with the two stacking buffer sortation panels at right angles so as to permit a corner installation.

As was mentioned above, the positive retention of sequence as a result of shingling (overlapping) and also the fact that mail is positively held between belts at all times is a very important feature. Because letters are kept under control at all times (between belts) the chances for letters to get out of sequence are minimized. Letters flow through the system in this manner at all times other than when they are singulated for scanning and diverting, at which time changing sequence in response to data from the scanner and associated electronics is inherently necessary. The part of the system that normally could be the most susceptible to losing sequence is the sweeping and stacking of sequenced letters into the mail trays. The system and machine of the present invention accomplishes that task in a completely safe and totally automatic manner by running the stream of shingled letters directly into the mail trays from the second pass buffers. Again, because of the shingling, the sequence cannot be lost.

Natural gravity is utilized to assist registration in the buffer stackers. The machine is constructed on a substantially vertical plane with a slant back which gives the operator full view and easy access to all letters being processed. The disposition of the stacking buffers provides a compound angle entrance thereto, with this angle being designed for gravity assist both in registration and tail edge clearance of the diverted mailpiece as it enters the throat of each stacking diverter. The flowing nature of the stream of shingled letters from the second pass buffer stackers enables simple and reliable automatic traying of sequenced letters.

Other objects and advantages will become apparent to those skilled in the art when the attached drawings are read in conjunction with the detailed description and the claims.

DETAILED DESCRIPTION OF THE DRAWINGS

DETAILED DESCRIPTION

The present intention of the U.S. Postal System is to reduce the labor factor in mail delivery to hold down the need for postage increases. As was indicated above, the average carrier in an urban setting will have approximately 1000 delivery points to handle on a daily basis, with approximately 3000 pieces of mail to be delivered. The goal is to provide sufficient equipment so that each carrier will have access to a system for automatically sorting the mail carrying his particular zip code. The present intention is to provide equipment which will accomplish the sorting in two passes of $32 \times 32 = 1024$ delivery points.

Figure 1:
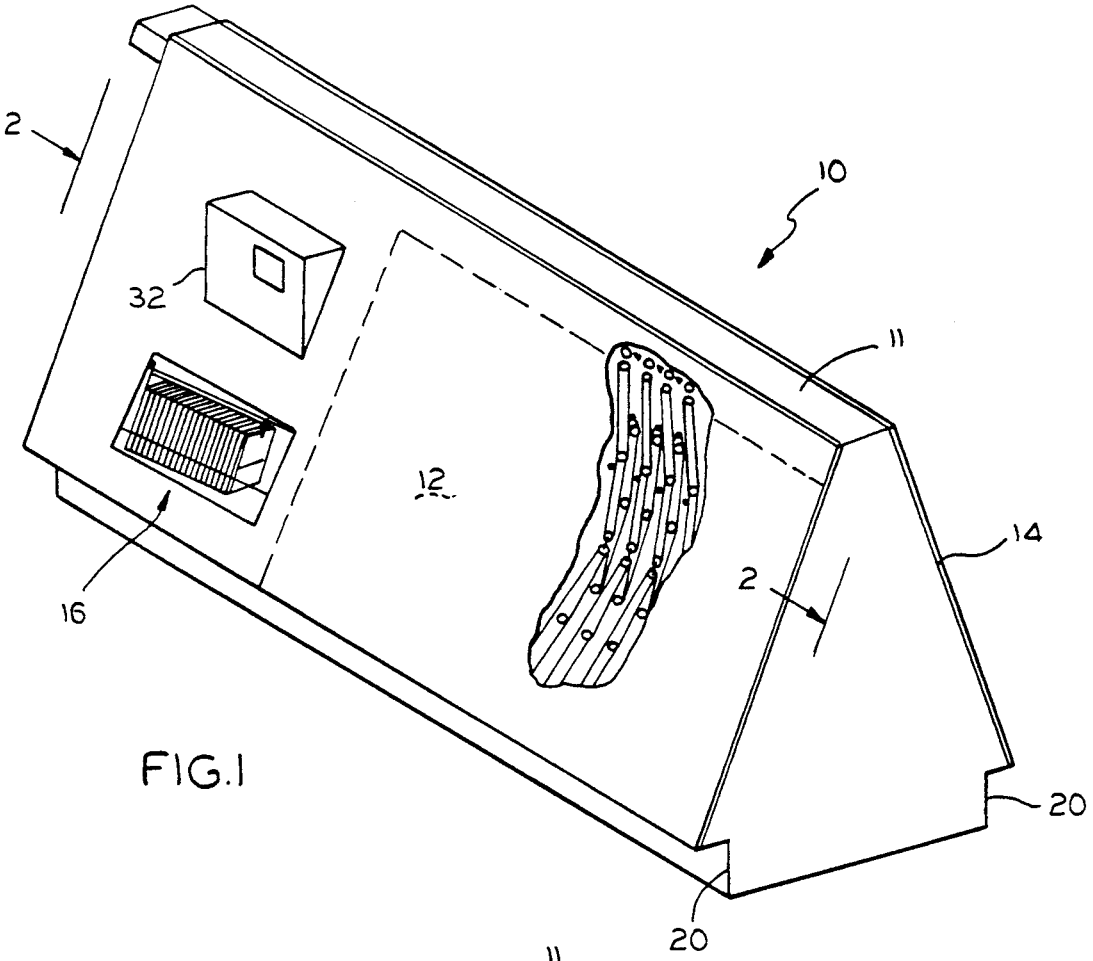
FIG. 1 is a perspective schematic view, partially cut away, of a preferred embodiment of the present invention.

Referring now to the drawings, wherein similar parts are designated by similar numbers, FIG. 1 is a perspective view of a schematic presentation of an elongated A-frame type of device or structure 10 embodying the preferred system contemplated by the present invention. The mechanism is generally mounted on the two slant-back surfaces forming the front and back sides, with cover means generally covering the fastest moving portions of the system, while leaving access to the slower moving portions, as will be described hereinafter. The ergonomic features of the present invention are shown schematically in FIG. 1A wherein a schematic male operator is shown to the left and a schematic female operator is shown to the right of an end schematic view of the present invention. Average heights from the floor level and angular disposition of operator arm extensions are shown in the illustration. The manual introduction of letters into the input feed means 16 is accomplished at approximately waist level.

The theory of operation of the present invention is to utilize a two-pass system for the delivery sequence sortation of mail handled by the local carrier. The two-pass method of sortation described herein can be used for both the 32 sort stacker and the 64 sort stacker Carrier Sequence Bar Code Sorter (hereinafter referred to as CSBCS and where the term "Sequence" relates to the sequential arrangement of the stops on a single carrier's delivery route). The two-pass system requires that all mail pieces fed into the CSBCS, for a particular carrier sort run, be read by the CSBCS bar code reader twice. The initial reading of the bar code (the "1st Pass") will occur as an operator feeds the mail pieces into the CSBCS. After all mail has been fed by the operator, and sorted to the sort stackers, the CSBCS will automatically recirculate the mail, using the correct sort stacker sequence, past the bar code reader a second time(giving the "2nd Pass"). The mail will again be sorted to the sort stackers, at which point the mail will be in proper delivery sequence. Described herein is a two-pass sortation system using 32 stackers for both the first and second passes of mail. While this is the system given as the illustrative embodiment, any future production machines may require an expansion on the number of sort stackers used for this illustrative embodiment, to allow for an increased number of sortation separations. Preferably, a sort program generation of programs for the CSBCS using the two-pass system should be configured to allow an expansion of the number of sort stackers, without drastic changes to existing sort programs.

In a two-pass system, the CSBCS will use the first pass of mail to distribute mail pieces in such a manner that when the mail is processed through a second pass, and each sort stacker buffer (containing mail from the first pass) is processed in sequence, the mail will be in the proper delivery sequence. A system that uses 32 sort stacker buffers for the first pass and 32 sort stacker buffers for the second pass is referred to as a Module 32 system. Similarly, if the system is expanded to include 50 sort stacker buffers, then it is a Module 50 system.

The following is a simplistic example of a two-pass system (although this example uses four sort stackers for the first pass and thirteen sort stackers for the second pass, as opposed to the required 32 sort stackers for the first pass and 32 for the second pass, as mentioned above, the theory is still the same): An operator who wishes to can use the CSBCS to sort a deck of playing cards (52 cards, excluding Jokers) by number, then color then icon in just two passes. After the two-pass sort the desired order is: #1. 2 of Diamonds (red), 2 of Hearts (red), 2 of Clubs black), and then the 2 of Spades (black); #2. 3 of Diamonds (red), 3 of Hearts (red), 3 of Clubs (black), and then the 3 of Spades (black); . . . etc. (4–10, J,Q, K,) up to . . . #13. Ace of Diamonds (red), Ace of Hearts (red), Ace of Clubs (black), and then the Ace of Spades (black). The Operator feeds a shuffled deck of cards into the CSBCS, which in turn sorts (first pass) all Diamonds (red) to the first sort bin, all Hearts (red) to the second sort bin, all Clubs (black) to the third sort bin, and all Spades (black) to the fourth sort bin. After all 52 cards have been sorted through the first pass, the CSBCS automatically recirculates the cards (hence the second pass) to a second set of 13 sort bins. During the second pass, the CSBCS processes all mail cards in the first sort bin (of the initial set of four sort bins) and distributes the 2 of Diamonds to the first sort bin, the 3 of Diamonds to the second sort bin, etc. up to the Ace of Diamonds to the Thirteenth sort bin. Similarly, after all cards from the first sort bin have been processed a second time, the CSBCS will process all cards contained in the second sort bin (Hearts), and distribute the cards (in the same manner as for the second pass for Diamonds) on top of the Diamonds to the set of thirteen sort stackers. The CSBCS will continue to process the second pass with sort bin #3 (Clubs) and then sort bin #4 (Spades) until all cards from the initial set four stackers have been properly sorted to the set of thirteen stackers. After the second pass is complete, the CSBCS automatically unloads the cards from the second set of thirteen stackers, with bin #1 first, then from bin#2, etc., through bin#13 last, to an output stacker. All the operator need do is pick up the 52 cards, now in the desired order, from the output stacker.

There is not much difference between this playing card sort example, and a two-pass system used to sort a carrier's mail into his delivery walk sequence. In the sort card example, the CSBCS uses 4 sort stackers, then 13 sort stackers to sequence the cards and allows for $4\times13=52$ possible separations. Similarly, a two-pass system that uses 32 sort stackers and the 32 sort stackers to sequence mail, gives $32\times32=1024$ possible separations. A two-pass system for carrier sequencing would look as follows:

After the first pass, mail will be distributed to the 32 sort stackers so that, sort bin #1 contains all mail for the 1st, 33rd, 65th . . . through 993rd delivery stop, sort bin #2 contains all mail for the 2nd, 34th, 66th . . . through 994th delivery stop, . . . etc., through sort bin #32, which contains all mail for the 32nd, 64th, 96th . . . through the 1024th delivery stop.

After the first pass is complete, a second pass of mail will be performed. During the second pass the CSBCS will sort all of the mail from sort bin#1 first, then all of the mail from sort bin#2 next, etc., in bin sequence, and finally sort bin#32. After the second pass, mail will be distributed to the 32 stackers such that, second pass sort bin#1 will contain all of the mail for the 1st delivery point on top of which will be all of the mail for the 2nd delivery point, etc. up to all of the mail for the 32nd delivery, second pass sort bin#2 will contain all of the mail for the 33rd delivery point on top of which will be all of the mail for the 34th delivery point, etc., up to all of the mail for the 64th delivery, . . . etc., through second pass sort bin#32 will contain all of the mail for the 993rd delivery point on top of which will be all of the mail for the 994th delivery point, . . . etc., up to all of the mail for the 1024th delivery point.

The basic approach of the present invention is to utilize belt means for controlled machine handling of all of the mail, to eliminate all operator handling or sweeping, between the initial manual introduction into an input feed and singulation means until the mail is sorted in the desired sequential relation and automatically fed into mail trays for loading into the delivery vehicle or carrier bag. Instead of the normal flat stacking of sorted mail in flat bins, as used heretofore, this invention utilizes spaced opposed belts having a substantially vertical, generally non-linear disposition for expansive acceptance and control of the mail items (hereinafter called letters) in stacker buffers. The letters are sorted endwise into overlapped or shingled relation to the next adjacent letter in the stacker buffers.

A very novel feature is that the shingled mail flows through these stacker buffers—in one end and out the other end. This is very important in the manner of recycling utilized in the present invention.

The actual sorting is accomplished by a bar code reader and associated electronics and computer chip means. The bar code reader (BCR) reads the whole 11-digit code and then translates the code to a number from 1 to 1024, each number of which identifies a separate delivery point or stop, which bears no relation to the zip code. The individual postman carrier determines how he wants to deliver, and he establishes his own route and determines the stop numbers, and after he has picked the sequence of numbers that come out after sorting, then the Post Office assigns one of the numbers from 1 to 1024 to each stop. The eleven digit zip code is placed on the envelope by the post office and is obtained from a national look-up directory, with another machine adding the eleven digit zip to the envelope. The present 9-digit code gets you to one side of a particular block on a particular street, while the 11-digit code gets you directly to a particular stop or house. The postman can go back and forth across a street or follow one side of the street according to his own personal preference for delivery.

Figure 1A:
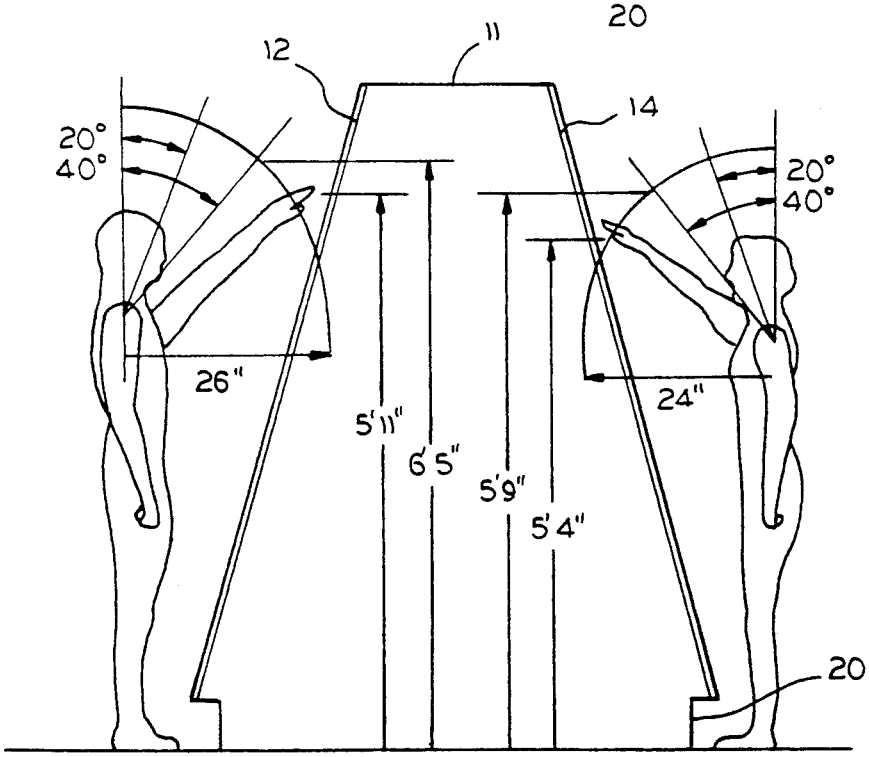
FIG. 1A is an end schematic view of the device of FIG. 1 with phantom ergonomic illustrations of a female and male operator in relation to the schematic view of the invention.

As was indicated previously, the preferred supporting structure for the present invention is a generally vertical member 10 having a slight slant back towards the top to insure that the letters will gravitationally be attracted to the planar members defining the slanting front side 12 and the slanting back side 14 (See FIGS. 1 and 1A.). These sides not only define a reference plane for orientation of the bottom edge of the letters "L" but also serve as the main support means for the system mounted thereon. The underlying support structure is rigid and generally A-Frame in configuration with recessed kickplate means 20 at the base of each side to provide means for accommodating the feet of operators when in close proximity to the structure.

Figure 2:
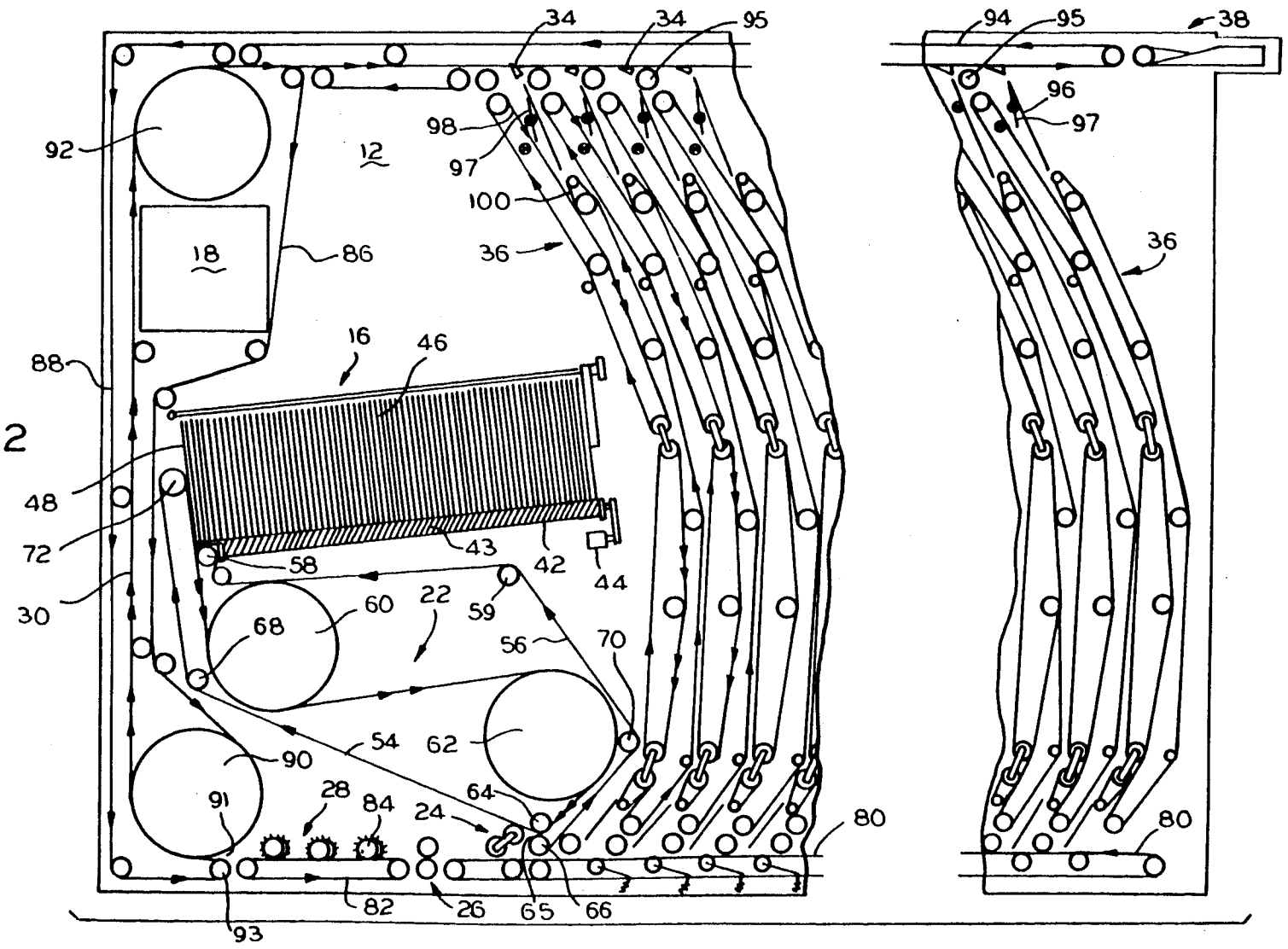
FIG. 2 is a partial frontal elevational view taken along line 2—2 in FIG. 1, showing the first pass side of the machine and illustrating the input feed tray, the singulator, the first pass buffer stackers and the appropriate delivery mechanism to the second pass mechanism located on the back side of the machine.
Figure 3:
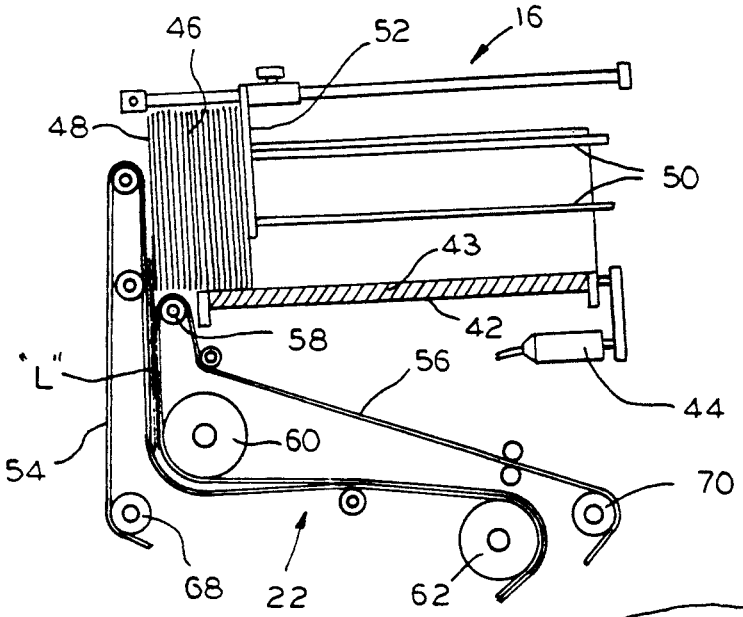
FIG. 3 is a partial perspective view of the input feed tray with an auger type roller or shaft for jiggling and delivering the manually stacked letters sequentially to the double opposed belt feeding means.

The slanting front side 12 supports several individually functional devices which are all important elements in the overall performance of the present invention. Referring to FIG. 2, these elements include: an input feeding means 16, a first transporting means 22, a singulating means 24, accelerating means 26, a bottoming station 28, a second transporting means 30, a bar code reader 18 and associated electronic and computer means 32 (generally shown as an external control panel in FIG. 1, but otherwise not shown), a plurality of first sorting means in the form of diverting vanes 34, an equal number of first pass stacker buffer means 36 and, a reversing member 38 for transporting letters from the front side 12 to the back side 14 while at the same time retaining the same orientation relative to the planar surface as the letters go around the corner. The slanting back side 14 (FIG. 11) supports a plurality of second sorting means in the form of diverting vanes 40, an equal number of second pass stacker buffer means 42, and an automatic mail tray loader means 44.

Referring now to FIGS. 2–5, the input feeding means or loader 16 includes at least one downwardly sloped roller or shaft 42 suitably powered by a motor and power transmission means 44 which can, if desired, include a helicle ridge or auger means 43 on shaft 42 for jogging the load of letters 46 downwardly to the discharge end 48 thereof. The main planar member 12 carries a pair of ridges 50 (FIG. 3) against which the letters rest to provide limited contact therewith for reducing the friction between the letters and the supporting structure. A spring loaded backup plate 52 assists in the movement of the bundle of letters 46 which are stacked on one end thereof with the address side of the letters facing the discharge end of the feeding or loading means 16.

The first transporting means 22 (FIGS. 2 and 3) includes two endless resilient conductive belts 54 and 56. Since it is difficult, in the presence of much detail in reduced size drawings, such as FIG. 2, to show single and confronting double belts, a single arrow on a belt denotes a single belt, while a double inline arrow denotes a pair of juxtaposed belts adapted to carry letters therebetween. Belt 54 addresses the letter at the discharge end 48 and produces a downwardly directed force on its address face, while belt 56 riding on roller 58 contacts the bottom end of the endmost letter and forces it into tighter engagement with belt 54 acting on its face. The letter "L" rides between belts 54 and 56 around the enlarged rollers 60 and 62 and bends into the nip or throat 65 between rollers 64 and 66, respectively. The continuous belt 56 reverses direction around roller 66 and returns upwardly around roller 70 towards roller 59 (FIG. 2) and to its start at roller 58, while belt 54 is bent abruptly around roller 64, thence upwardly around roller 68 into reversing roller 72 to its point of origin. The letter "L" delivered through throat 65 is deflected by deflector 74 (FIG. 4) projecting out of the planar member 12 to direct the letter "L" into engagement with the lower perimeter belt 80 for direction into the singulator 24, which will now be described in detail.

Referring to the enlarged views of FIGS. 5A and 5B, the prior art singulators shown in FIG. 5A utilized a fixed power roller 224 and a spring loaded power roller 226 positioned below that is powered in the same direction as roller 224, through a spring loaded clutch 228. Roller 226 is caused to rotate in the same direction when the rollers are tangentially contacting and the friction therebetween causes this mutual rotation as indicated by the arrows. If a single document passes through the bite or nip of the rollers it will cause the lower roller to over-ride the spring clutch 228 and rotate counterclockwise as shown. However, if two or more documents are presented to the bite or nip of the rollers, the lower roller 226 will revert to its original rotation and move in the clockwise direction as the clutch 228, thereby causing the additional documents to move backward into the stack from whence they came, while the first or top document will be fed forward by roller 224.

In the present invention a new and novel approach is utilized, namely, a singulator roller 230 including a gear means 232 on at least one end thereof, which is mounted on arm 234 that is pivoted at 236. (FIG. 5B.) Also mounted on pivot axis 236 is a complimentary powered gear means 238 that meshes with gear means 232 and is adapted to drive singulator roller 230 in the direction indicated by the arrow "A". However, with the direction of rotation of gear means 238 there is an incident of a vertical force in the direction of the arrow "B" which causes the singulation roller 230 to have an aggressive bite on the top surface of any document, or the top document of a stack of more than one document being carried on belt means 80.

Figure 4:
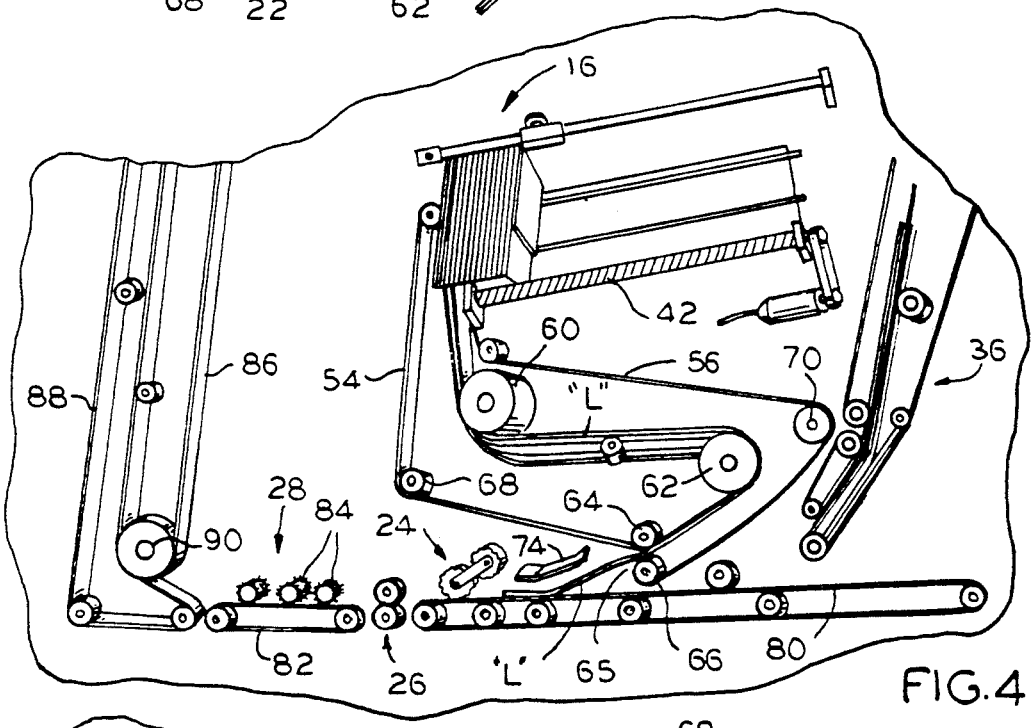
FIG. 4 is a partial perspective view illustrating the infeeding of letters by means of belts from the infeed tray, through a singulation means, a bottoming means to orient the bottom edge of the letters with a reference plane to enable the indicia to be positioned in the proper plane when presented to the bar code or character reader.
Figure 5:
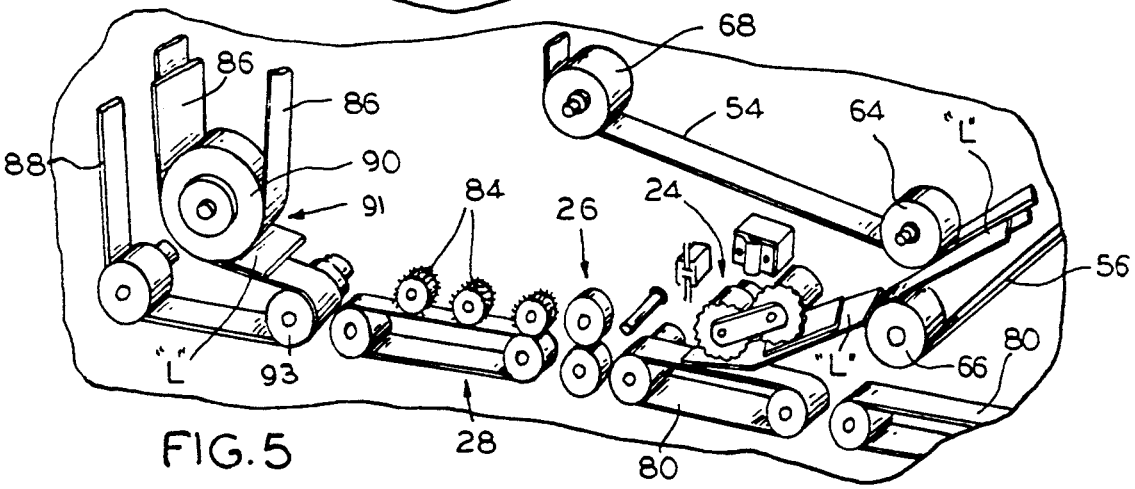
FIG. 5 illustrates the secondary geared feed means for use as singulation means in this embodiment.
Figure 5A:
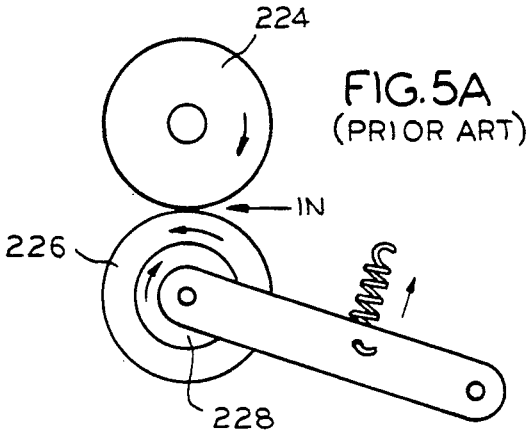
FIG.5A (PRIOR ART)
FIGS. 5A and 5B are schematic enlargements of singulation rollers of the type found in the prior art and as utilized in the present invention, respectively.
Figure 5B:
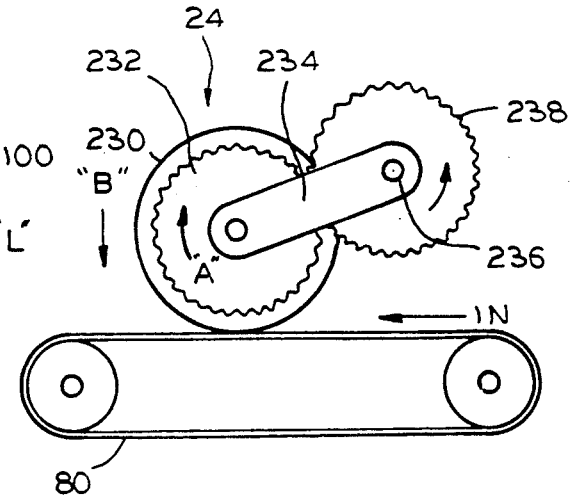
Figure 7:
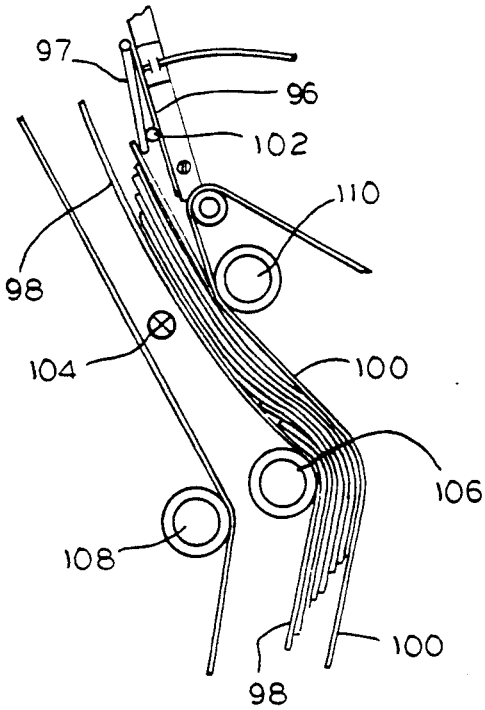
FIG. 7 is a partial elevational view of the upper central portion of a buffer stacker of the type utilized in FIG. 2.
Figure 8:
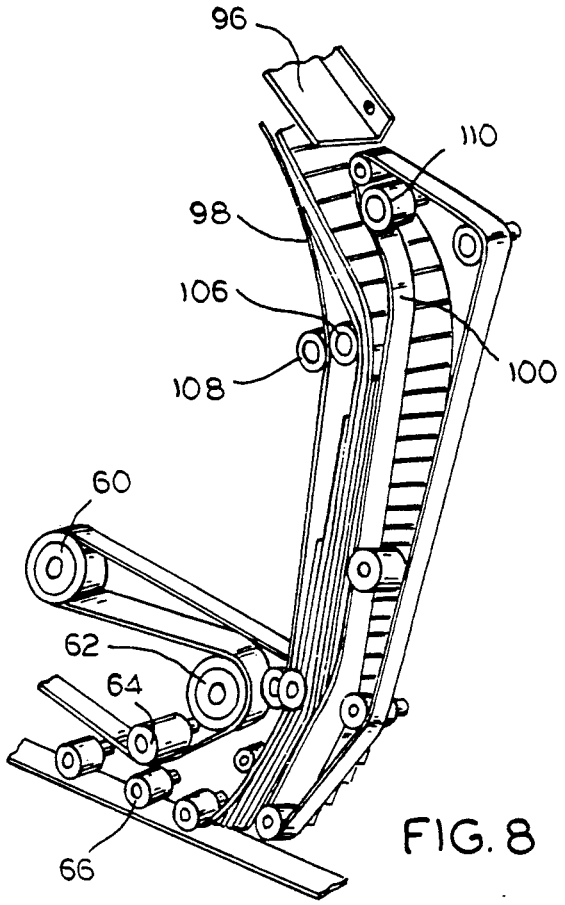
FIG. 8 is a partial perspective view of a buffer stacker with a substantially full load of letters.

After singulation of any plural letters delivered to the singulator 24, each letter is accelerated by the roller means 26 into the settling or bottoming station 28 (FIGS. 2, 4, and 5). Bottoming station 28 includes a power driven belt means 82 and two or more brushes 84 having their axes askew rather than perpendicular to front side plate 12 (FIGS 1 and 1A.). This causes the bottom edge of the letters to be moved into firm contact with the reference plane formed by the face of front side plate 12 to insure that the bar code on the letters are in the proper position for reading by the bar code reader means 18.

The properly bottomed letters are then delivered to the second transport means 30 which includes resilient conductive belts 86 and 88. The belt 86 comes downwardly as viewed in the FIGS. 2 and 5 to bend around the enlarged roller 90 and at the lower side thereof, as viewed in the drawings, is joined by belt 88 to engage and support singulated bottomed letters delivered by brushes 84 and belt 82 into the throat or nip 91 formed by roller 90 and reversing roller 93 carrying belt 88. The letter "L", with its lower edge bottomed on plate 12 is carried past the bar code reader 18 (FIG. 2) and read, with the information being conveyed by appropriate signal means, not shown, to electronic and computer means 32, shown in FIG. 1, for interpretation and issuance of signals for instruction to the appropriate sorting means in the form of diverters 34. For some perspective of the linear speeds at which letters are handled in this system; the lower perimeter belt 80 and the first transporting means 22 move at the rate of approximately 20"/sec.; the singulator roller 230 has a lineal speed of 100"/sec.; the accelerator rollers 26 move at 150"/sec. linearly; the settling or bottoming station 28 has a lineal speed of 150"/sec.; and the second transporting means 30 has a lineal speed of 150"/sec.

The first pass sorting means includes diverter gates or vanes 34 (FIGS. 2 and 6) which are of the leading blade type, actuated by a double acting rotary solenoid. This arrangement provides the most simple and reliable diverter action for the transport speed (150"/sec.) and an envelope gap (3" to 4" minimum) established for this sorter application. The double acting solenoid eliminates the need for a return spring and this provides faster actuation times. The leading blade gate in its closed position also provides better guiding of the envelope as it goes past each stacker buffer. The gate width is made large enough to reliably deflect the full range of letter sizes. The gate pivot shaft is supported at both ends for maximum stability during operation. To avoid the envelope tripping on the tip of the gate, the gate 34 straddles the transport belt 94 when open and straddles a guide roller 95 when closed.

Referring now to FIGS. 2 and 6–8, the stacker buffer means 36 are equal in number to the Module's first pass. In this preferred embodiment there are proposed to be thirty two (32) stacker buffer means on the front side 12 and the same number on the back side 14. As the first letter engages the gate diverter means 34 and enters the stacker buffer 36, its leading edge slides down the fixed guide means 96. The momentum of the envelope, aided by the force of gravity,. carries the letter down until it rests on top of stacker belt 98 with its leading edge against the curve of stacker belt 100. If the letter is thicker than about 1/16", the letter will cause the flexible thickness sensor, consisting of a moveable arm contact means 97 engaged by the envelope, to be moved whereby it actuates the light pipe 102 which signals the stacker belt drive clutch, not shown, to turn on. This causes the stacker belts 98 and 100 to pull the letter down into a position tangential to the curve of stacker belt 98, adjacent roller 106, pushing stacker belt 100 laterally away to accommodate the thickness of the letter. At this point, the letter thickness sensor, light pipe 102, signals the stacker belt drive clutch to turn off, thus stopping the belts. When the next letter enters the stacker, it settles on top of the previous letter with their lead edges offset or shingled roughly by ¼", which is the amount the belts incrementally moved for the first letter. The letter thickness sensor, light pipe 102, when actuated by the moveable contact means 97 breaking its beam, causes the stacker belts to increment until the letter is pulled down into a position tangential to the curve of stacker belt 100, thereby pushing the first letter and stacker belt 98 back to accommodate the letter thickness. The same sequence of events repeats for each arriving letter or a few letters when the letters are thin. The amount of shingling and the thickness of the resulting shingled stack will depend on the thickness and length of the letters. The average leading edge offset is typically about ¼" and this can be adjusted by the setting of the letter thickness sensor. This setting, by changing the amount of offset or shingling, also influences the thickness of the shingled stack, which is expected to be in the 1½" to 2" range. The length of the belt stacker buffer is about 6 feet. The length required to accommodate an 8" vertical stack (conventional) of letters is about 3 to 5 feet, depending on the length of the shingled letters. Notice that the capacity of the belt stacker buffer 36 increases dramatically as the length of the letters decreases, unlike a conventional vertical stacker. For example, the stacker buffer can easily hold a 22 inch stack of 5 inch vertical long envelopes.

Figure 6:
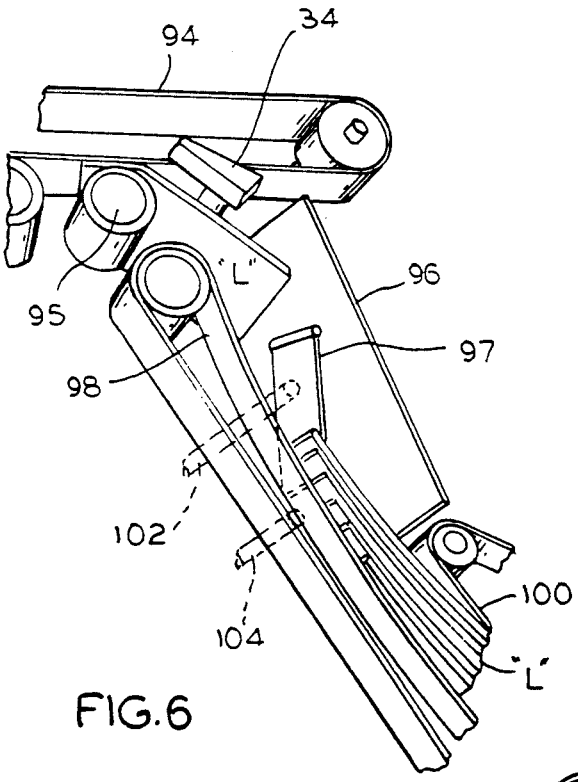
FIG. 6 is a partial perspective view of the upper entrance to a buffer stacker, the diverter means, deflection means, sensing means and secondary belt means, showing the upper end of shingled letters forming the stack.

The stack thickness sensor 104, which measures the thickness of the shingled bundle of envelopes when belt 98 is flexed to the left, as viewed in FIG. 6 of the drawings, and the belt overlies the sensor 104, rarely comes into play under normal operating conditions because the letter thickness sensor 102 will provide the appropriate amount of shingling. However, when the arriving letters are consistently thick and long (near the end of the specification range) the shingled stack thickness will tend to build up beyond 2 inches. The stack thickness sensor 104 which is normally set at about 1¾" will anticipate this condition and advance the stacker belts until the stack thickness decreases below the adjustable sensor setting. This will prevent the shingled stack thickness from increasing beyond 2 inches, this being an arbitrary design choice and not a limitation.

The stack thickness sensor 104 is not required to be a high precision device. Therefore, a simple reflective (diffuse) fiber-optic sensor can be used which directly looks for the edge of the bottom (left-most as seen in the drawing) envelope in the stack. (Fiber-optic sensors are used wherever appropriate in this system for simplicity, reliability, noise immunity, maintainability, cost effectiveness, and ease of manufacture.) The letter thickness sensor precision requirement is somewhat higher. This is accomplished by using a lightly spring-loaded contact or arm 97 that rests on top of the last letter that entered the stacker buffer. The position of this arm is monitored by a reflective fiber-optic sensor, such as light pipe 102 (identical to the stack thickness sensor 104), which looks at the edge of the arm 97. This arrangement makes the sensor independent of the envelope color and other surface characteristics and provides accurate sensing.

Getting the trailing edge of the last letter out of the way of the next letter entering the stacker buffer is a tricky problem in most sorters. It is recognized that this is particularly important in the CSBCS system because of the need to maintain sequence integrity, besides avoiding jams. Several design features of the belt stacker buffer work together to effectively deal with the trailing edge control problem:

a) Each letter enters an open space and thus can settle unimpeded all the way to the fixed stop position against the curve of stacker belt 100.

b) Gravity aids the momentum of the entering letter for it to fall through a fixed distance so as to get the trailing edge out of the way of the next letter.

c) The leading edge of the entering letter slides down the fixed guide 96 instead of along the last envelope which could have seams or flaps or other surface imperfections that the entering envelope could stumble on.

d) The geometry of the lower end of the flexible guide 97 in relation to the letter leading edge stop point (curve of stacker belt 100) and the point of exit from the letter transport track is such that the lower end of the fixed guide biases the trailing edge of the letter down and away from the path of the next letter.

e) The geometry of stacker belts 98 and 100 and the rollers 106 and 108 that they go around is such that each letter that is drawn into the stack is flexed so as to bias the trailing edge away from the path of the next letter entering the stacker buffer.

The above features ensure reliable stacking performance, without sacrificing design simplicity. With each letter entering the stacker entering an open space, this and the tilted disposition of the stackers result in the stacker entry area working as an effective settling station. Aided by gravity, each mail piece settles with its bottom edge registered against the tilted base plate 12 of the stackers. This produces consistently good stacking quality.

Figure 9:
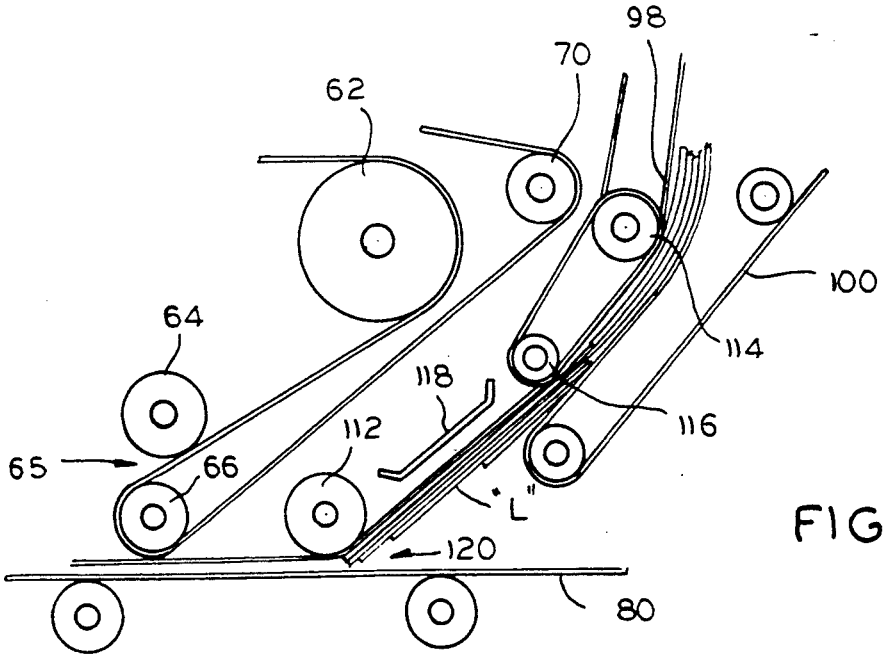
FIG. 9 is partial elevational view of the lower end of a buffer stacker and the means for sequentially unloading such stacker for further transport of the letters to the second pass means.
Figure 9A:
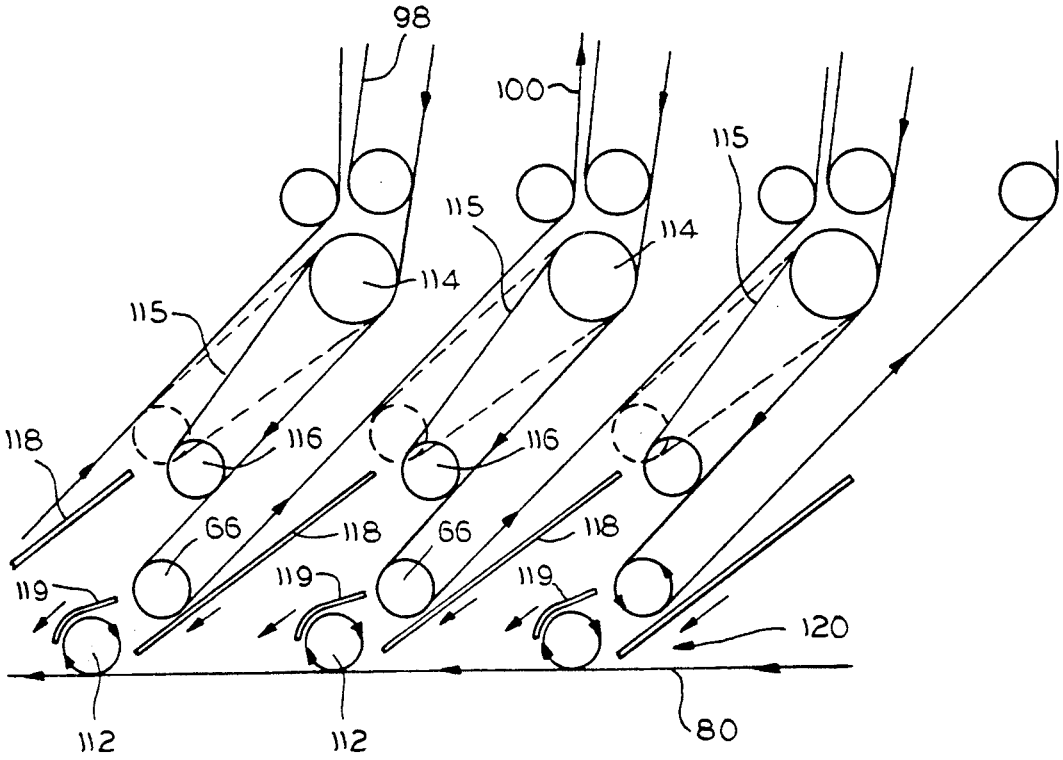
FIG. 9A is a schematic detail of a the lower end of a group of stacking buffer illustrating one embodiment of a deflector means.

As was previously explained, when the first pass sorting of the letters is complete and the letters are all reposing in one of the stacker buffers 36, the letters are then permitted to egress sequentially from the particular stacker buffers. The discharge of sorted envelopes is illustrated in FIG. 9 where the letters "L" are discharged from between the belts 98 and 100 and guided by deflector 118 into the throat or nip 120 between perimeter belt 80 and the guide roller 112. As can be seen in the enlarged view of FIG. 9A, it is desirable to also provide a small curved deflector 119 over the top of the roller 112 to prevent contact by the shingled letters passing between belt 100 and the short moveable belt 115 mounted on rollers 114 and 116 that are carried by and pivotable about the axis of roller 114, as shown in phantom, to provide an enlarged opening for the egress of thick letters, so as to not over-stress belt 100. The deflector 119 and guide 118 insure that the letters are directed to underlie the rollers 112 on belt 80 and also to avoid contact with belt means moving in the opposite direction from that desired for the letters moving through the system.

The letters then proceed to the singulator 24 where their shingled condition enhances and makes the singulation of the shingled letters much easier for the second pass. The singulated letters pass the bar code reader 18 for a second time, and with the gates 34 all closed, the preferred embodiment has the letters pass through the reversing mechanism 38 which maintains the proper orientation of the letters as they are diverted around the corner to the back side plate 14 for the second pass sortation.

Figure 10:
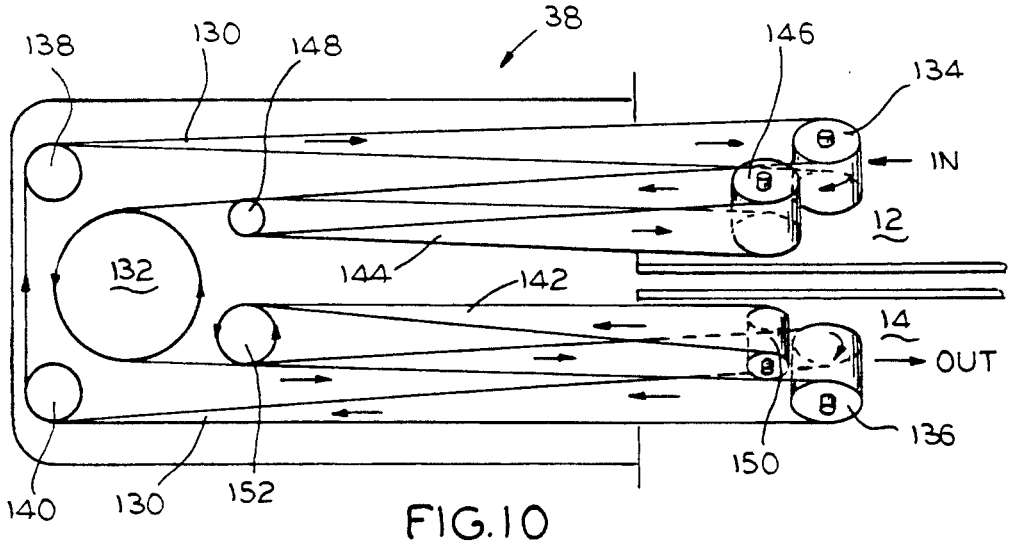
FIG. 10 is a plan view of the reversing mechanism which causes the letters to pass from the front side to the back side of the mechanism and present the same orientation of the envelope to the back side second pass stacking buffers as was presented to the front side first pass stacking buffers.

FIG. 10 illustrates in plain view a mechanism wherein eight small rollers and one larger roller in combination with three belts permit a letter to pass from the front side 12 to the back side 14, and still maintain its orientation as it moves between the two sides. An elongated belt 130 changes direction around the rotating enlarged roller 132, is half twisted in opposite directions to encircle the sideways disposed spaced rollers 134 and 136, and is then straightened out and passed around upwardly disposed spaced rollers 138 and 140. Two shorter belts 142 and 144 are respectively twisted about 90 degrees and brought into juxtaposed relation with the twisted sections of the main belt 130 by means of rollers 146,148 and 150,152, respectively. The envelopes are fed in between belt 144 and the main belt 130, twisted 90 degrees to an upright position to pass around enlarged roller 132, then twisted in the opposite hand to be released from between belts 130 and 142, and discharged out from the throat formed by the two rollers 136 and 150 into gripping engagement by belts 160 and 162 on the back side 14 (FIG. 11).

Based on the information garnered by the bar code reader 18 on its second pass reading, the second pass sorting is carried out by the opening of the appropriate vanes 40 for diverting the letters into the appropriate stacker buffer. The illustration in FIG. 11 is symbolic and does not include an adequate number of stacker buffers for a 32 module second pass. A production model would include the increased number of stacker buffer units 42 for the appropriate 32 module sort.

Figure 11:
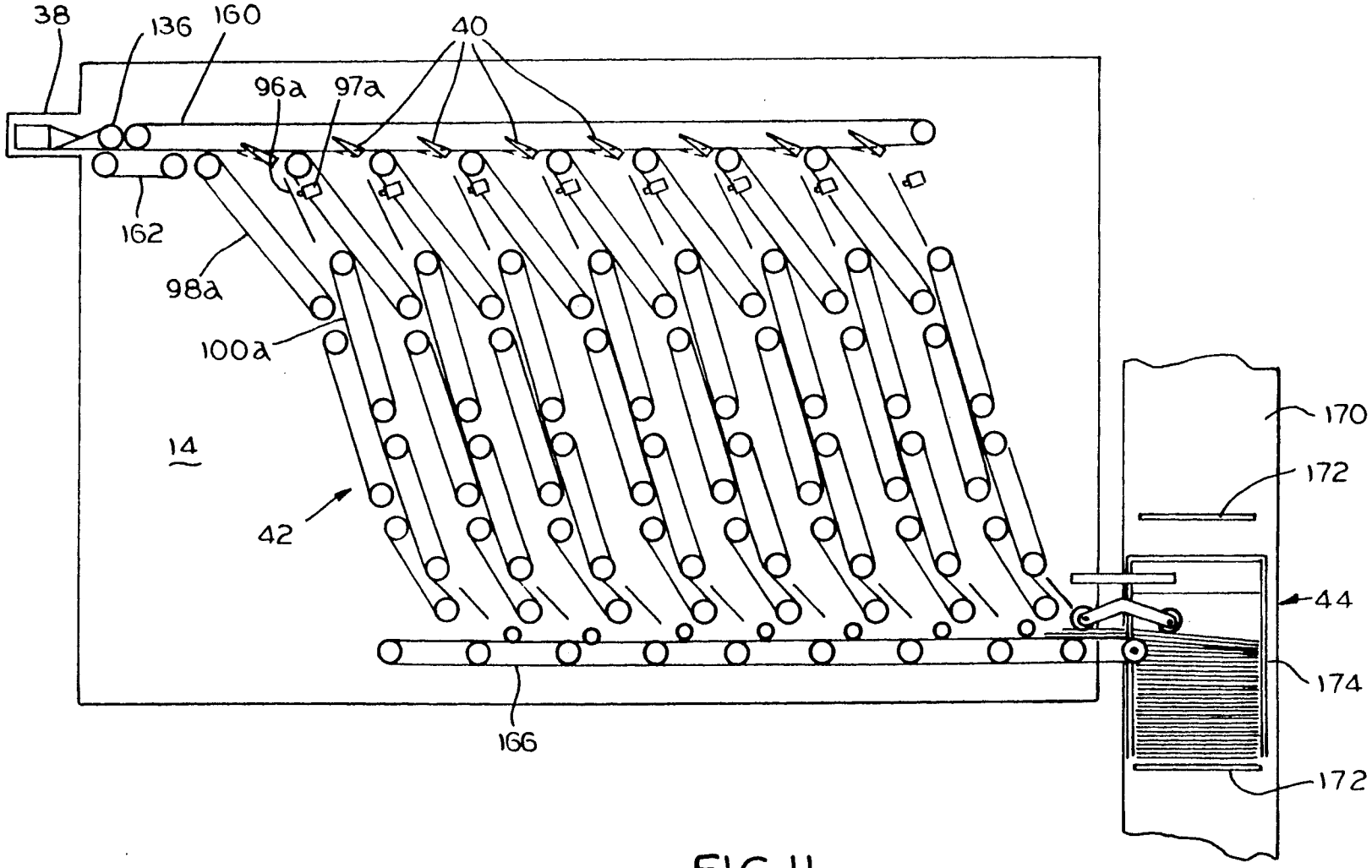
FIG. 11 is a backside view of the mechanism (opposite to the frontside where the first pass stacking buffers are shown in FIG. 2) and shows the second pass stacking buffers.

It will be noted that where the first pass stacker buffers 36 are generally convex in geometrical configuration and provide a free circular flow of letters in from the left of the illustration of FIG. 2 and out to the left thereof, the second pass stacker buffers 42 of FIG. 11 enter from the left and exit to the right in a more straight line configuration from top to bottom. The basic operation of the stacker buffers 42 is substantially similar to the operation of the stacker buffers 36 and utilize similar sensing means for controlling the operation of the belt means 98a and 100a forming the stacker buffers 42.

Figure 12:
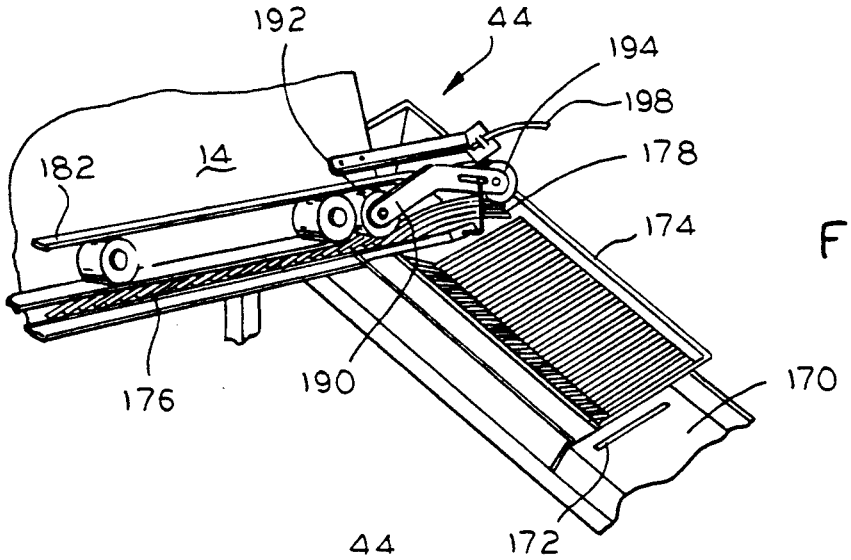
FIG. 12 is a partial perspective view, slightly from the left, of shingled sorted letters being fed in sequential order into mail tray delivery means located on a moveable belt means.
Figure 13:
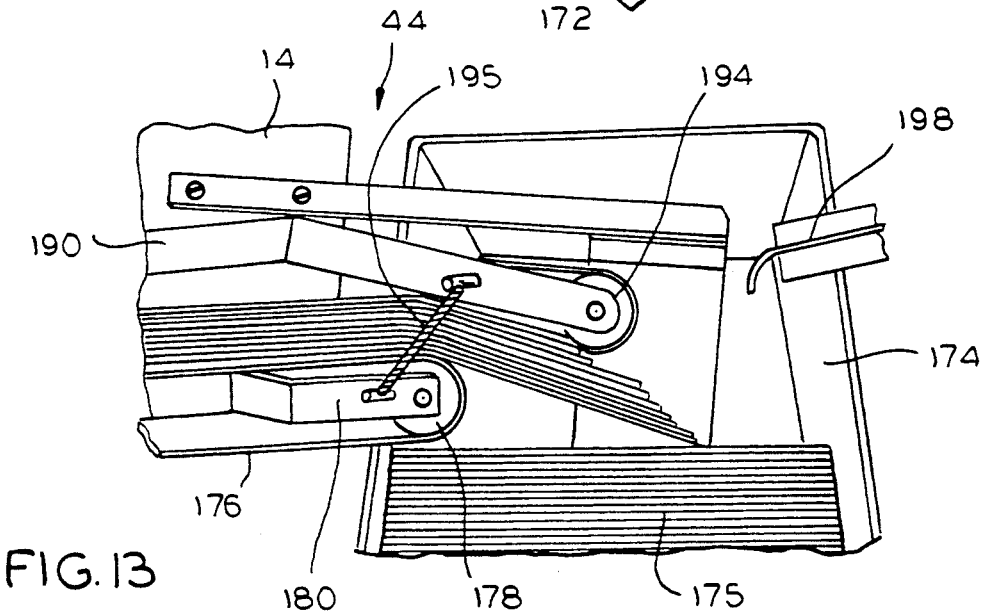
FIG. 13 is an enlarged partial front elevational detail of the tray inserter means shown in FIG. 12.
Figure 14:
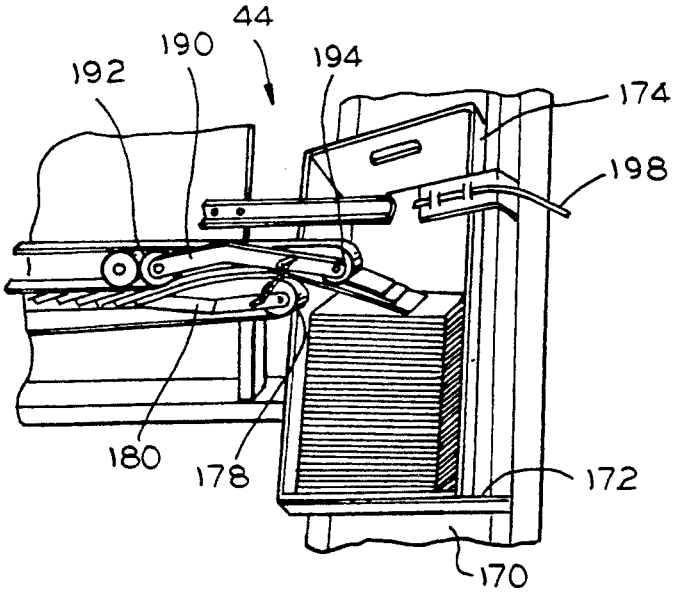
FIG. 14 is a partial frontal perspective view, slightly from the right, of the feeder means, mail tray, sensing means and the tray delivery belt means.

When the second pass sortation has been completed, the shingled bundles of letters are sequentially discharged from the appropriate stacker buffers 42 onto the belt 166 and sequentially moved to the automatic mail tray loading means 44. (See FIGS. 11 and 12.) The automatic loader means 44 includes a moveable belt means 170 having transverse integral bar means 172 for positive positioning of mail trays 174 of the type normally utilized by carriers when they sweep the sorted mail for delivery. Referring now to FIGS. 12-14, the The shingled sequentially sorted letters are carried between belts, the lower belt 176 terminating at and being reversibly mounted on roller 178 which is supported in laterally projecting fashion from the edge of back side plate 14 by means of arm 180 which overlies the adjacent margin of a mail tray 174. Mail proceeding sequentially between belts 176 and an upper belt 182 encounters a pivotable teeter-totter like member 190 that is provided with a pair of end rollers 192 and 194. The extreme end thereof at roller 194 is spring loaded downwardly by spring means 195 (FIG. 13) so that the letters 175 progressing over the end of belt 176 moving over roller 178 are bent downwardly into the mail tray 174. The moveable belt 170 moves at a rate predetermined by the presence or absence of letters 175 as determined by the sensing means 198, which will slow up or hasten the movement of belt 170 to either provide more letters 175 or fewer, as the case may be. The spring-loaded roller 194 slows down the movement rate of the shingled letters 175 and, because of its power of deflection, insures delivery sequentially into the tray 174. The deflection tends to maintain the letters in shingled relation and, hence, eliminates the aerodynamic feature of high speed letters passing through the equipment. A novel feature of this automatic traying means is that there are high rates of mail transfer at low velocity of mail, since the mail is shingled. Mail moves at 20 inches/sec. into the trays. Traying at 45,000 pieces of mail/hour at a linear speed of 20"/sec. is due to shingling. Slow feed speed eliminates bounce of letters and also eliminates aerodynamics of letters, which could cause flying and unwanted separation.

Figure 15:
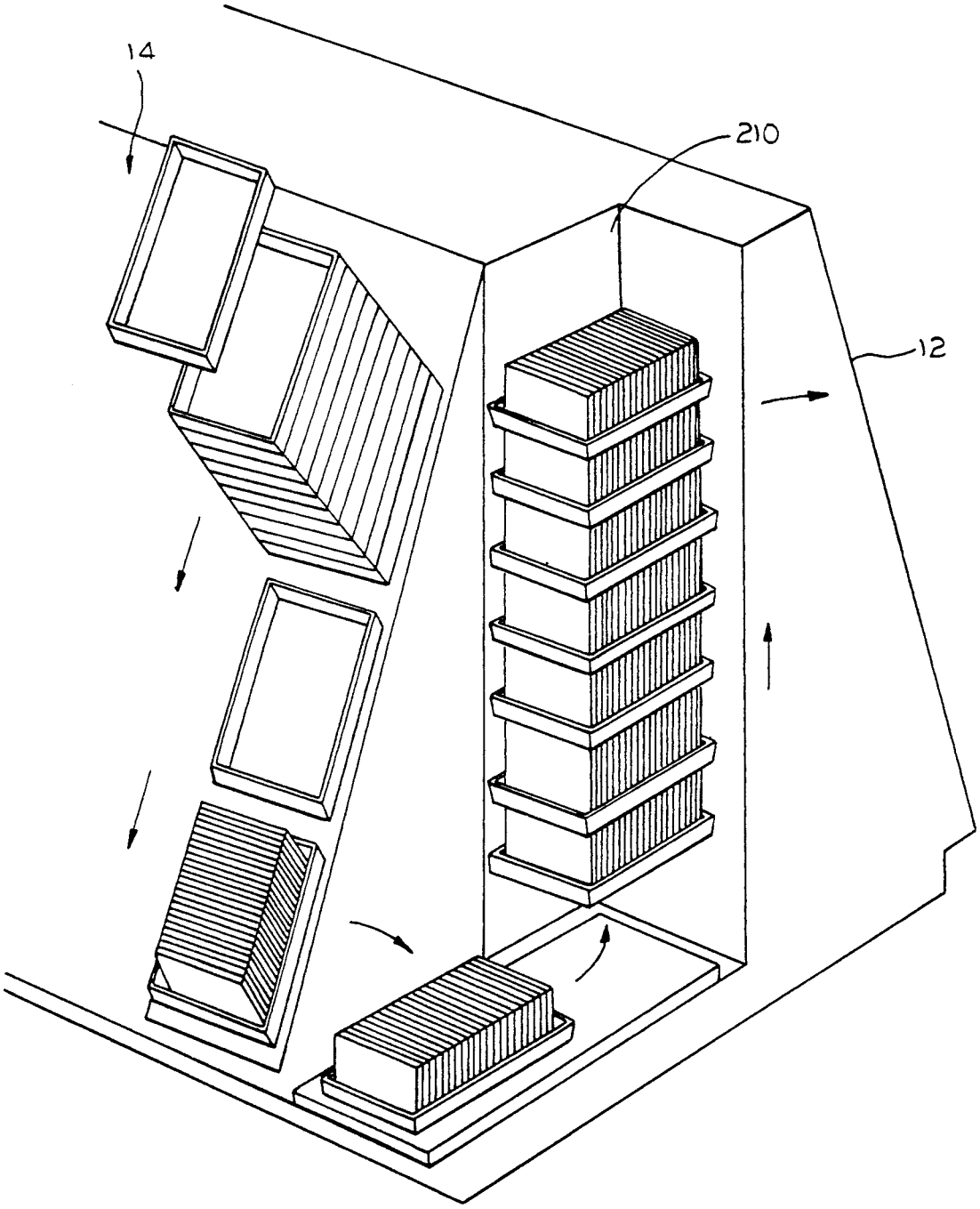
FIG. 15 is a partial perspective view of one embodiment of a tray delivery means and tray stacking means holding sequentially sorted mail trays awaiting unloading.
Figure 17:
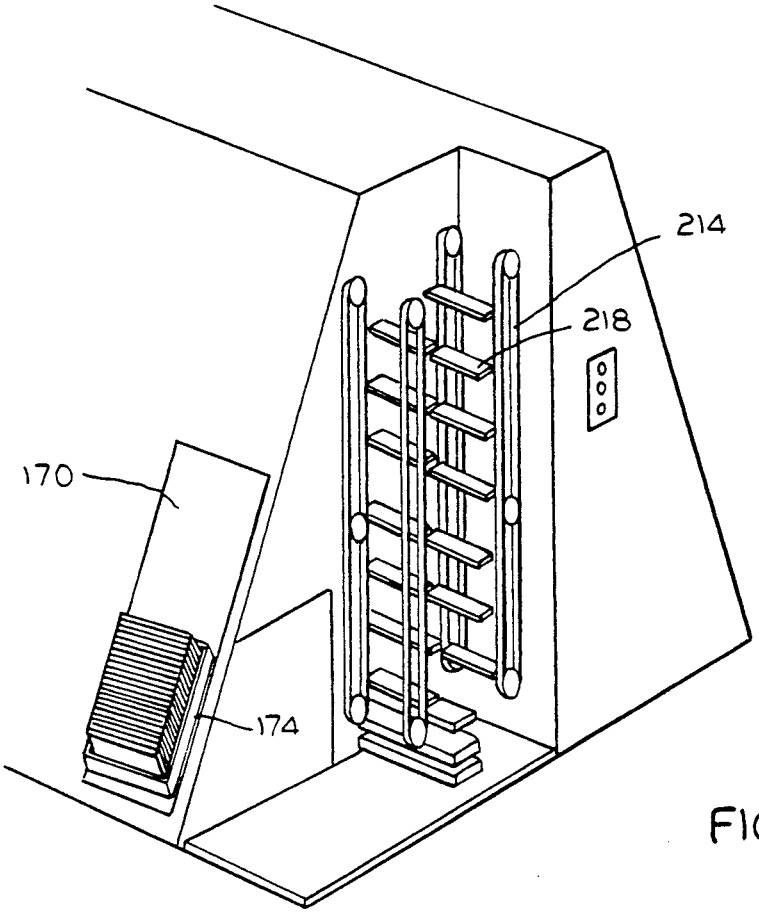
FIG. 17 is still another perspective view of an embodiment of a tray stacking means awaiting unloading.
Figure 18:
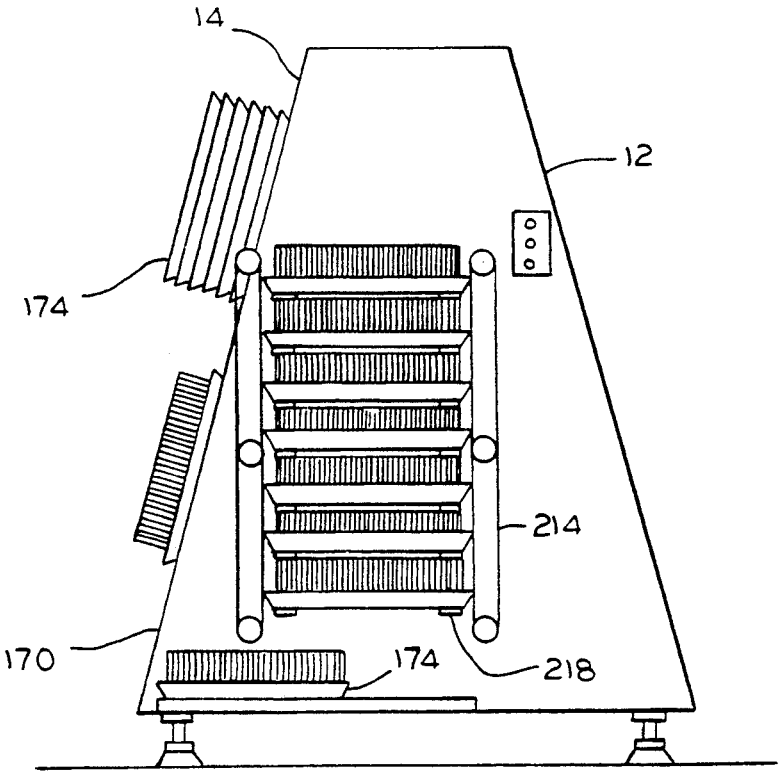
FIG. 18 is an end schematic view of the sorter and stacker means shown in FIG. 17.
Figure 16:
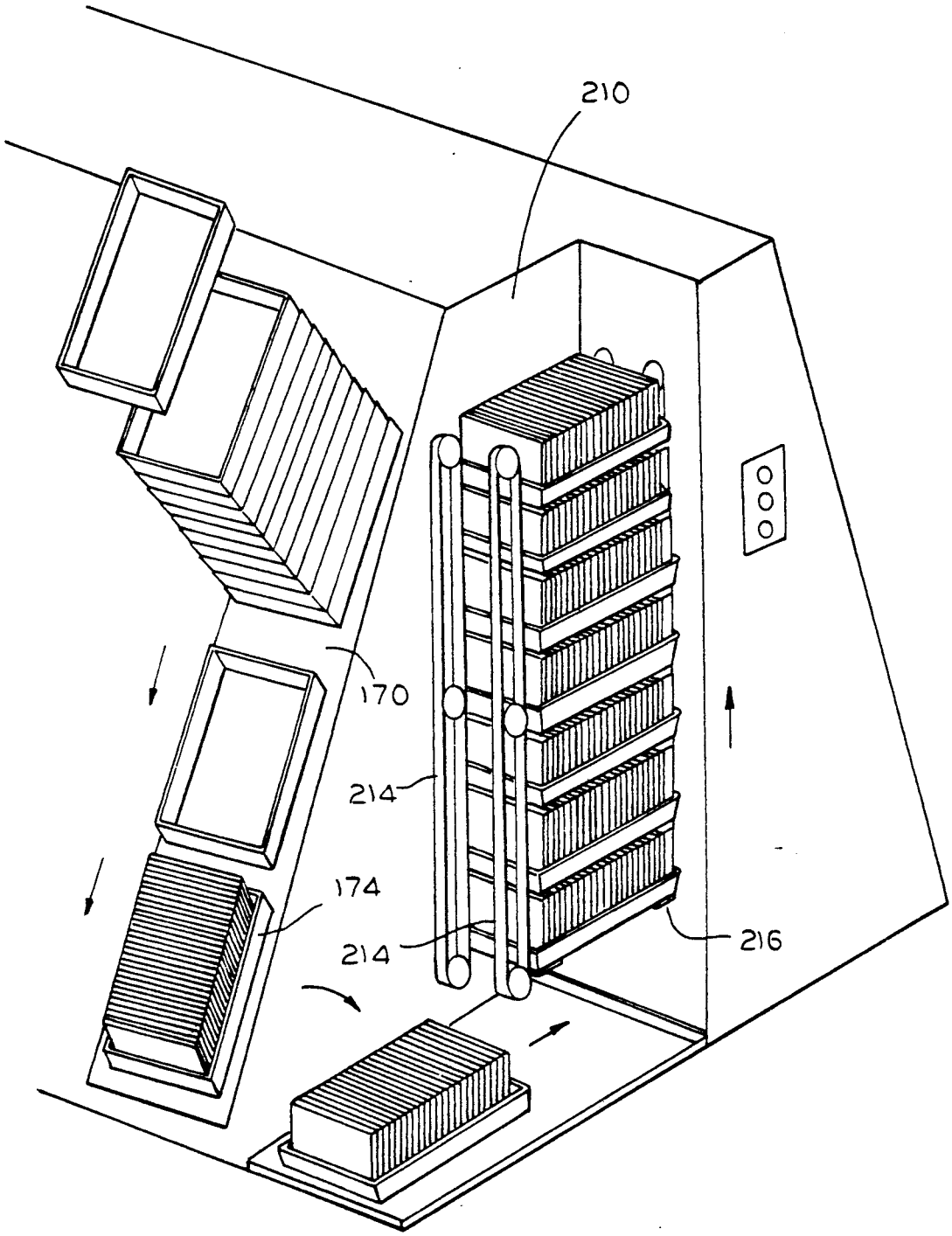
FIG. 16 is a partial perspective view of a second embodiment of a tray delivery and stacking means awaiting unloading.

FIGS. 15-18 illustrate various configurations of mail tray stacking means for storing stacked filled trays prior to movement to transportation after sorting. In each instance provision is made for stacking empty trays near the belt means feeding individual trays into position for automatic filling. Recess means 210 is provided in the back side 14 for the stacking of filled trays, as seen in FIG. 15. FIG. 16 shows a similar device with continuous belts 214, and with supported pad means 216 for underlying the trays and permitting mechanically assisted stacking means to be utilized. The device shown in FIGS. 17 and 18 is similar to that shown in FIG. 16. However, the pads 216 are replaced by full width support shoulders 218.

Other embodiments will become apparent to those skilled in the art, however, it is our intent to be limited only by the scope of the appended claims when interpreted by the specification to which they are attached.

We claim:

1. A singulation device, suitable for use in a multi-pass bar code sorter apparatus for sorting documents, which comprises a powered belt means, a singulation roller assembly including a singulation roller overlying and adapted to contact said belt means, said roller assembly being mounted on one end of a pivotable arm means, said arm means being pivotable about a pivot axis spaced from the axis of rotation of said singulation roller, and positive powered drive means mounted on said pivot axis and engaging said singulation roller assembly for power transmission thereto without interfering with the interaction of said singulation roller with said belt means, said positive powered drive means when delivering power from said positive powered drive means to said singulation roller producing a downwardly directed force applied by said singulation roller to a document on the belt means to increase the normal force against the document moving on said belt means to insure positive engagement between said roller and the document.

2. A singulation device as claimed in claim 1 wherein said positive powered drive means includes a driven first gear means, and the singulation roller assembly includes a second gear means coaxial with and integrally connected to an end of said singulation roller, said second gear means having a smaller diameter than said singulation roller and said second gear means being powered and rotated by operative engagement with said first gear means.

3. A singulation device, suitable for use in a multi-pass bar code sorter for sorting documents, which comprises a powered belt means, a singulation roller assembly including a rotatable singulation roller adapted to maintain contact with said belt means except when a document passes therebetween, a pivotable arm means having a first end mounting said singulation roller assembly and having a pivotable second end including a pivot axis spaced from the axis of rotation of said singulation roller, and positive powered drive means mounted on said second end engaging said singulation roller assembly for transmitting power thereto without interfering with the contact interaction of said singulation roller with said belt means, said positive powered drive means when delivering power from said positive powered drive means to said singulation roller producing a downwardly directed force applied by said singulation roller to a document on the belt means to increase the normal force against said document moving on said belt means to insure positive engagement between said roller and said document.

4. A singulation device according to claim 3 wherein said powered belt means is in a substantially horizontal orientation and said singulation roller is in an overlying relationship with said belt means and contacts the upper surface of said belt means.

5. A singulation device according to claim 4 wherein said positive powered drive means includes a driven first gear means, said singulation roller assembly includes a second gear means operatively connected to rotate said singulation roller, and said second gear means is powered and rotated by operative engagement with said first gear means.

6. A singulation device according to claim 5 wherein said second gear means is coaxial with and integrally connected to an end of said singulation roller.

7. A singulation device according to claim 6 wherein said second gear means has a diameter which is smaller than the diameter of said singulation roller.

8. A singulation device according to claim 3 wherein said positive powered drive means is mounted on said pivot axis.

9. A singulation device according to claim 8 wherein said positive powered drive means includes a driven first gear means, said singulation roller assembly includes a second gear means operatively connected to rotate said singulation roller, and said second gear means is powered and rotated by operative engagement with said first gear means.

10. A singulation device according to claim 9 wherein said second gear means is coaxial with and integrally connected to an end of said singulation roller.

11. A singulation device according to claim 10 wherein said second gear means has a diameter which is smaller than the diameter of said singulation roller.

12. A singulation device according to claim 3 wherein said positive powered drive means includes a driven first gear means, said singulation roller assembly includes a second gear means operatively connected to rotate said singulation roller, and said second gear means is powered and rotated by operative engagement with said first gear means.

13. A singulation device according to claim 12 wherein said second gear means is coaxial with and integrally connected to an end of said singulation roller.

14. A singulation device according to claim 13 wherein said second gear means has a diameter which is smaller than the diameter of said singulation roller.

15. A singulation device, suitable for use in a multi-pass bar code sorter apparatus for sorting documents, which comprises a powered belt means, a singulation roller assembly including a singulation roller overlying and adapted to contact said belt means and a second gear coaxial with and integrally connected to an end of said singulation roller, said second gear means having a smaller diameter than said singulation roller, said roller assembly being mounted on one end of a pivotable arm means, said arm means being pivotable about a pivot axis spaced from the axis of rotation of said singulation roller, and a positive powered drive means including a driven first gear means, said second gear means being powered and rotated by operative engagement with said first gear means wherein the direction of rotation of said first gear means causes a downwardly directed force on said singulation roller to thereby increase the normal force of said singulation roller against a document moving on said belt means to thereby insure positive engagement with the document.

16. A singulation device, suitable for use in a multi-pass bar code sorter for sorting documents, which comprises a powered belt means, a singulation roller assembly including a rotatable singulation roller adapted to maintain contact with said belt means except when a document passes between said belt means and said singulation roller and including a second gear means operatively connected to rotate said singulation roller, said powered belt means is in a substantially horizontal orientation and said singulation rollers in an overlying relation with said belt means and contacts the upper surface of said belt means, a pivotable arm means having a first end mounting said singulation roller assembly and having a pivotable second end including a pivot axis space from the axis of rotation of said singulation roller and positive power drive means including a driven first gear means mounted on second end operatively connected to rotate said singulation roller and said second gear means as powered and rotated by operative engagement with said first gear means, the direction of rotation of said first gear means causes the rotation of said second gear means to impose a force on said singulation roller which is perpendicular to the contacted surface of the belt means to thereby increase a normal force of said singulation roller against a document passing between said contacted surface and said singulation roller without interfering with the contact interaction of said singulation roller with said belt means.

* * * * *